US006153844A

United States Patent [19]

Hyono et al.

[11] Patent Number: 6,153,844

[45] Date of Patent: Nov. 28, 2000

[54] INTEGRATED KEY TOP ASSEMBLY

[75] Inventors: Tadashi Hyono; Manabu Uchizawa, both of Tokyo, Japan

[73] Assignee: Mitsubishi Denki Kabushiki Kaisha, Tokyo, Japan

[21] Appl. No.: 09/048,585

[22] Filed: Mar. 27, 1998

[30] Foreign Application Priority Data

Mar. 27, 1997 [JP] Japan ..... 9-075610

[51] Int. Cl.[7] ..... H01H 13/70

[52] U.S. Cl. ..... 200/343; 200/5 A; 200/517; 200/341

[58] Field of Search ..... 200/5 A, 517, 200/341–345; 400/472, 490, 491, 491.2, 495, 495.1, 496

[56] References Cited

U.S. PATENT DOCUMENTS

| | | | |
|---|---|---|---|
| 4,559,427 | 12/1985 | Dolson et al. | 200/159 B |
| 4,638,151 | 1/1987 | Suwa | 235/145 R |
| 4,977,298 | 12/1990 | Fujiyama | 200/5 A |
| 4,997,998 | 3/1991 | Bauer | 200/345 |
| 5,927,483 | 7/1999 | Yamada | 200/343 |
| 6,005,209 | 12/1999 | Burleson et al. | 200/343 |

FOREIGN PATENT DOCUMENTS

| | | | |
|---|---|---|---|
| 57-11430 | 1/1982 | Japan | H01H 21/00 |

*Primary Examiner*—Michael Friedhofer
*Attorney, Agent, or Firm*—Leydig, Voit Mayer, Ltd,

[57] ABSTRACT

Provided is a hinge type thinly configured integrated type key top in which the strength, durability, operability and other required conditions of a hinge portion are optimally designed assuring easy manufacturing and assembling as well as key input device and computer using the same. It is an integrated type key top in which a plurality of key tops are integrated with a peripheral frame portion. Each key top has in the vicinity of both ends of its specified one side a portion deformably connected to the frame portion via a hinge portion which extends approximately in a linear shape of a specified width and a specified thickness. The key top, the hinge portions and the frame portion are integrated with one another and made of a resin material, while the hinge portion has a thickness t (mm) and a total width w (mm) which are set so that $8 \leqq 20t+w \leqq 14$ is satisfied in a range of $0.25 \leqq t \leqq 0.6$ and $2 \leqq w \leqq 10$.

8 Claims, 12 Drawing Sheets

INTEGRATED KEY TOP ASSEMBLY

BACKGROUND OF THE INVENTION

The present invention relates to a integrated type key top and key input device and computer using the same.

Conventionally, as a key input device of a computer, a word processor or the like, there has been a known one in which each key top is operated via a guide mechanism or a pantograph mechanism in closing its electric contact by depressing the key top.

In recent years, there has been a growing demand for reductions in size, weight and, above all, thickness of, in particular, portable computers of a notebook type and the like, and as part of this trend, it has been also required to further reduce in thickness the key input device.

However, in the case of the one employing the aforementioned conventional guide mechanism or pantograph mechanism, there is required a space in which such a mechanism is placed between the key top and the electric contact, and therefore, it is primarily difficult to achieve a sufficient reduction in thickness.

In view of the above, as disclosed in the document of Japanese Utility Model Laid-Open Publication No. HEI 6-38358, it can be considered to reduce the space between the key top and the electric contact as far as possible by connecting each key top to a peripheral frame portion via a hinge and operating the key top in a state in which the key top is supported by this hinge.

However, in the case of this hinge type, although the key input device can be further reduced in thickness by compacting the space below the key top (between the key top and the electric contact), it is required to take the following factors of, in particular, the hinge portion into consideration. The factors are: the strength (absolute strength capable of withstanding damage and the like due to the effect of an external force); durability (fatigue strength) with respect to repetitive key input operations; a required operating power in depressing the key; a reliability in switch operation with respect to a variation in operating force effecting position; a facility in manufacturing and assembling and so on. However, it has been very difficult to optimally set the dimensions (length, thickness, total width, etc.), position and so on of the hinge portion so that these factors are satisfied with a reduction in thickness of the key input device achieved.

In regard to the length of the hinge portion, each key portion is limited in size by the area of the keyboard, the key arrangement and the like, and each key top itself is required to have an area not smaller than a specified area in terms of the key input operability. Therefore, an interval between the frame portion and the key top is limited. The length of the hinge portion is normally defined by this interval between the frame portion and the key top, and therefore, it cannot be set longer than a specified length.

Furthermore, in regard to the thickness and width (sum total of width width of each hinge portion×number) of the hinge portion, both of them are preferably great in terms of securing the strength (absolute strength) of the hinge portion, but on the other hand, a key top depressing force increases, consequently reducing the operability.

In other words, the thickness of the hinge portion is preferably small in terms of the influence on the operating force, however, it had better be thick for the purpose of securing a strength (absolute strength). In general, the square of the hinge thickness effects on the durability directly influenced by a stress, and the cube of the hinge thickness effects on the operating force directly influenced by a spring force.

On the other hand, the width (sum total of width) of the hinge portion had better be narrow in terms of reducing the operating force, however, it had better be wide for the purpose of securing a strength (absolute strength). The hinge width effects linearly on the operating force directly influenced by the spring force. It is to be noted that, even if the hinge width is great, the hinge width produces a small effect on key operating forces in the transverse direction or a diagonal direction, which are normally not taken into consideration, and therefore, the absolute strength is influenced relatively less by the hinge width.

In regard to the position of the hinge portion (i.e., an argument about where to provide the hinge portion around the key top), in a case where the hinge portion is provided in a center portion of a specified side of the key top and an operating force is exerted on an end portion displaced in the hinge width direction from the center portion of the key top (in the case of so-called one-sided depressing), the other side end is disadvantageously lifted by a torsional deformation of the hinge portion, resulting in hardly closing the electric contact. That is, it is difficult to keep the reliability of the switch operation with respect to the variation in effecting position of the operating force. This becomes significant in the case of a horizontally elongated key top.

Furthermore, in the normal key input operation, a stroke of the key top is caused by a displacement about a point of the hinge portion fixed to the frame portion, and key top is displaced until its stroke motion will be regulated by a predetermined stopper portion. In other words, the displacement stroke of the key top is suppressed within a specified range by the operation of the aforementioned stopper portion, and therefore, provision of the hinge portion throughout the entire width of a side of the key top (i.e., not only at the end portions but also at a center portion of a side) exerts less favorable influence on the improvement of the durability (fatigue strength). The increase in hinge width rather requires an increased operating force, and if there is an attempt at avoiding this, the hinge thickness cannot help being reduced in thickness by that much, and this adversely causes a disadvantage of a difficulty in handling or the like when a separately formed hinge portion is incorporated.

As described above, it has been not so easy to optimally set the dimensions, position and so on of the hinge portion so that the aforementioned requirements are satisfied with a reduction in thickness of the key input device achieved.

SUMMARY OF THE INVENTION

The present invention has been developed in view of the aforementioned technical problems, and its object is to provide a hinge type thinly configured integrated type key top in which the strength, durability, operability and other required conditions of the hinge portion are optimally designed assuring easy manufacturing and assembling as well as key input device and computer using the same.

Therefore, in a first aspect of the present invention, there is provided an integrated type key top in which a plurality of key tops are integrated with a peripheral frame portion, wherein each key top has in the vicinity of both ends of its specified one side a portion deformably connected to the frame portion via a hinge portion which extends approximately in a linear shape of a specified width and a specified thickness.

According to the first aspect of the present invention, each key top is pivotally connected to the peripheral frame portion via the hinge portion, and therefore, the space below the key top (i.e., the space between it and the electric contact) can be compacted in comparison with the one utilizing the conventional guide mechanism or pantograph mechanism, thereby allowing the key input device to be further reduced in thickness.

In this case, the hinge portion is provided in the vicinity of both the ends of the specified one side of the key top, and therefore, even when the key input operating force is effected on an end portion in the hinge width direction apart from the center portion of the key top (in the case of the so-called one-sided depressing), the other side end can be prevented from being lifted by a torsional deformation of the hinge portion, thereby preventing the possible occurrence of uneasy closing of the electric contact. That is, the reliability of the switch operation with respect to a variation in effecting position of the operating force can be improved in comparison with the case where the hinge portion is provided in the center portion of a specified one side of the key top.

Furthermore, the hinge portion is provided only in the vicinity of both the ends of the specified one side of the key top, and therefore, the hinge portion can be set to have a great thickness without causing an increase in the key input operating force in comparison with the case where the hinge portion is provided throughout the entire width of the aforementioned one side, allowing the strength (absolute strength) of the hinge portion to be increased. Consequently, the hinge portion can be prevented from being damaged by the effect of a key input operating force in, for example, the transverse direction or a diagonal direction, which is not normally supposed. Furthermore, the molding ability is improved when integrally forming the key top with resin.

A second inventive aspect of the present application is based on the aforementioned first inventive aspect and characterized in that the key top, the hinge portions and the frame portion are integrated with one another and made of a resin material.

According to the second inventive aspect of the present application, basically an effect similar to that of the aforementioned first inventive aspect can be produced. In particular, with regard to the plurality of key tops, there is the arrangement of integrating the key tops, the hinge portion and the frame portion with one another with a resin material. This arrangement does not require many processes nor works in the manufacturing and assembling stages in contrast to the case where a key top and a peripheral frame portion which are formed separately from each other are assembled together by being connected by a hinge, so that the key top can be easily incorporated into the key input device, allowing the manufacturing cost to be reduced.

Furthermore, a third inventive aspect of the present application is based on the aforementioned second inventive aspect and characterized in that the hinge portion has a thickness t (mm) and a total width w (mm) which are set so that $8 \leqq 20t+w \leqq 14$ is satisfied in a range of $0.25 \leqq t \leqq 0.6$ and $2 \leqq w \leqq 10$.

The reason why the thickness t of the hinge portion is limited to the aforementioned range is that, when the hinge portion is integrated with the key top and the frame portion and made of a resin material, a sufficient durability cannot be obtained for a long-term use and sometimes the absolute strength runs short although a good operating feeling can be assured if the thickness t is smaller than 0.25 [mm], and the operating feeling is bad although the durability is sufficient when the thickness t exceeds 0.6 [mm]. The reason why the width (total width) w of the hinge portion is limited to the aforementioned range is that a sufficient durability cannot be obtained for a long-term use although a good operating feeling can be assured if the width w is smaller than 0.2 [mm], and the operating feeling is bad although the durability is sufficient when the width w exceeds 10 [mm].

Furthermore, the reason why the thickness t and the width (total width) w of the hinge portion are limited to the range of $8 \leqq 20t+w \leqq 14$ is that a sufficient durability cannot be obtained although a good operating feeling can be assured in the region of $8>20t+w$, and the operating feeling is bad although the durability is sufficient in the region of $20t+w>14$.

According to the third inventive aspect of the present application, basically an effect similar to that of the aforementioned second inventive aspect can be produced. In particular, the hinge portion has a thickness t (mm) and a total width w (mm) set so that $8 \leqq 20t+w<14$ is satisfied in the range of $0.25 \leqq t \leqq 0.6$ and $2 \leqq w \leqq 10$. With this arrangement, when the hinge portion is integrated with the key top and the frame portion with a resin material, a durability (fatigue strength) for a long-term use can be assured with the operability in the key input operation satisfactorily maintained.

A fourth inventive aspect of the present application is based on the aforementioned first inventive aspect and characterized in that the hinge portion is comprised of a sheet material made of a metal or resin material.

According to the fourth inventive aspect of the present application, basically an effect similar to that of the aforementioned first inventive aspect can be produced. In particular, the hinge portion is formed of a sheet material made of a metal or resin. With this arrangement, a material having superior mechanical and physical characteristics than those of the key top and the frame portion can be used for the hinge portion, and this can improve the strength (absolute strength) and durability (fatigue strength) of the hinge portion in comparison with the case where all these members are made of an identical material. In this case, the hinge portion is provided only in the vicinity of both the ends of the specified one side of the key top, and therefore, the hinge portion can be set to have a great thickness without causing an increase in key input operating force in comparison with the case where the hinge portion is provided throughout the entire width of the aforementioned one side, thereby allowing the strength (absolute strength) of the hinge portion to be increased. Consequently, the hinge portion can be prevented from being damaged by the effect of a key input operating force in, for example, the transverse direction or a diagonal direction, which is not normally supposed. Furthermore, the handling in setting the hinge portion (a sheet material made of a metal or resin) between the key top and the frame portion in the manufacturing stage is also improved.

Furthermore, a fifth inventive aspect of the present application is based on the aforementioned fourth inventive aspect and characterized in that the hinge portion is made of a metal sheet material and has a thickness t (mm) and a total width w (mm) which are set so that $4 \leqq 20t+w \leqq 8$ is satisfied in a range of $0.1 \leqq t \leqq 0.25$ and $1 \leqq w \leqq 6$.

The reason why the thickness t of the hinge portion is limited to the aforementioned range is that, when the hinge portion made of a metal sheet material is integrated with the key top and the frame portion, a sufficient durability cannot be obtained for a long-term use and sometimes the absolute strength runs short although a good operating feeling can be assured if the thickness t is smaller than 0.1 [mm], and the operating feeling is bad although the durability is sufficient when the thickness t exceeds 0.25 [mm]. The reason why the width (total width) w of the hinge portion is limited to the aforementioned range is that a sufficient strength cannot be obtained for a long-term use and the handling is difficult because the hinge width is too narrow if the width w is smaller than 1 [mm], and the operating feeling is bad although the durability is sufficient when the width w exceeds 6 [mm]. Furthermore, the reason why the thickness t and the width (total width) w of the hinge portion are limited to the range of $4 \leqq 20t+w$ s 8 is that a sufficient durability cannot be obtained although a good operating feeling can be assured in the region of $4>20t+w$, and the operating feeling is bad although the durability is sufficient in the region of $20t+w>8$.

According to the fifth inventive aspect of the present application, basically an effect similar to that of the aforementioned fourth inventive aspect can be produced. In particular, the hinge portion is made of a sheet material made of a metal and the thickness t (mm) and the total width w (mm) thereof are set so that $4 \leqq 20t+w \leqq 8$ is satisfied in the range of $0.1 \leqq t \leqq 0.25$ and $1 \leqq w \leqq 6$. With this arrangement, when the hinge portion formed of the sheet material made of a metal is integrated with the key top and the frame portion, a durability (fatigue strength) for a long-term use can be assured with the operability in the key input operation satisfactorily maintained.

Furthermore, a sixth inventive aspect of the present application is based on the aforementioned fourth inventive aspect and characterized in that the hinge portion is made of a resin sheet material and has a thickness t (mm) and a total width w (mm) which are set so that $7 \leqq 20t+w \leqq 12$ is satisfied in a range of $0.1 \leqq t \leqq 0.5$ and $2 \leqq w \leqq 10$.

The reason why the thickness t of the hinge portion is limited to the aforementioned range is that, when the hinge portion made of a resin sheet material is integrated with the key top and the frame portion, a sufficient durability cannot be obtained for a long-term use and sometimes the absolute strength runs short although a good operating feeling can be assured if the thickness t is smaller than 0.1 [mm], and the operating feeling is bad although the durability is sufficient when the thickness t exceeds 0.5 [mm]. The reason why the width (total width) w of the hinge portion is limited to the aforementioned range is that a sufficient durability cannot be obtained for a long-term use although a good operating feeling can be assured if the width w is smaller than 2 [mm], and the operating feeling is bad and sometimes the width exceeds the key top width although the durability is sufficient when the width w exceeds 10 [mm].

Furthermore, the reason why the thickness t and the width (total width) w of the hinge portion are limited to the range of $7 \leqq 20t+w \leqq 12$ is that a sufficient durability cannot be obtained although a good operating feeling can be assured in the region of $7>20t+w$, and the operating feeling is bad although the durability is sufficient in the region of $20t+w>12$.

According to the sixth inventive aspect of the present application, basically an effect similar to that of the aforementioned fourth inventive aspect can be produced. In particular, the hinge portion is formed of a sheet material made of resin and has a thickness t (mm) and a total width w (mm) set so that $7 \leqq 20t+w \leqq 12$ is satisfied in the range of $0.1 \leqq t \leqq 0.5$ and $2 \leqq w \leqq 10$. With this arrangement, when the hinge portion made of the sheet material made of resin is integrated with the key top and the frame portion, a durability (fatigue strength) for a long-term use can be assured with the operability in the key input operation satisfactorily maintained.

Furthermore, a seventh inventive aspect of the present application is based on the aforementioned first inventive aspect and characterized in that the key top has between its depressing operating portion and its end portion connected to the hinge portion a lowered portion which has a specified length and is set lower than the depressing operating portion.

According to the seventh inventive aspect of the present application, basically an effect similar to that of the aforementioned first inventive aspects can be produced. Furthermore, the lowered portion which has a specified length and is set lower in level than the depressing operating portion is provided between the depressing operating portion and the end portion connected to the hinge portion of each key top. Therefore, when performing a key input operation by depressing the key top, an operating force is hard to be effected on this lowered portion. With this arrangement, the point of action of the operating force can separate from the end portion connected to the hinge portion. This arrangement can effectively prevent the operating force required for closing the electric contact from increasing and prevent the effects of deteriorating the operability and applying an excessive stress on the hinge portion accompanying this.

An eighth inventive aspect of the present application is a key input device provided with a keyboard having a plurality of key tops, an electric contact provided in correspondence with each key top and a contact pressing member provided between the electric contact and the key top, characterized in that the electric contact is closed via the contact pressing member by an operation of depressing the key top and the keyboard is provided with the integrated type key top of the aforementioned first inventive aspect.

According to the eighth inventive aspect of the present application, basically an effect similar to that of the aforementioned first inventive aspects can be produced with regard to the integrated type key top incorporated into the key input device. In addition to this effect, a hinge type thinly configured key input device which can be assembled relatively easily and is optimally designed with regard to the required conditions of the hinge portion strength, durability, operability and so on can be obtained.

Furthermore, a ninth inventive aspect of the present application is a computer provided with the key input device of the aforementioned eighth inventive aspect.

According to the ninth inventive aspect of the present application, basically an effect similar to that of the aforementioned eighth inventive aspect can be produced with regard to the key input device incorporated into a computer. In addition to this effect, the computer can be further reduced in thickness.

DETAILED DESCRIPTION OF THE PREFERRED EMBODIMENTS (First Embodiment)

An embodiment of the present invention will be described in detail below with reference to the accompanying drawings.

Figure 1:
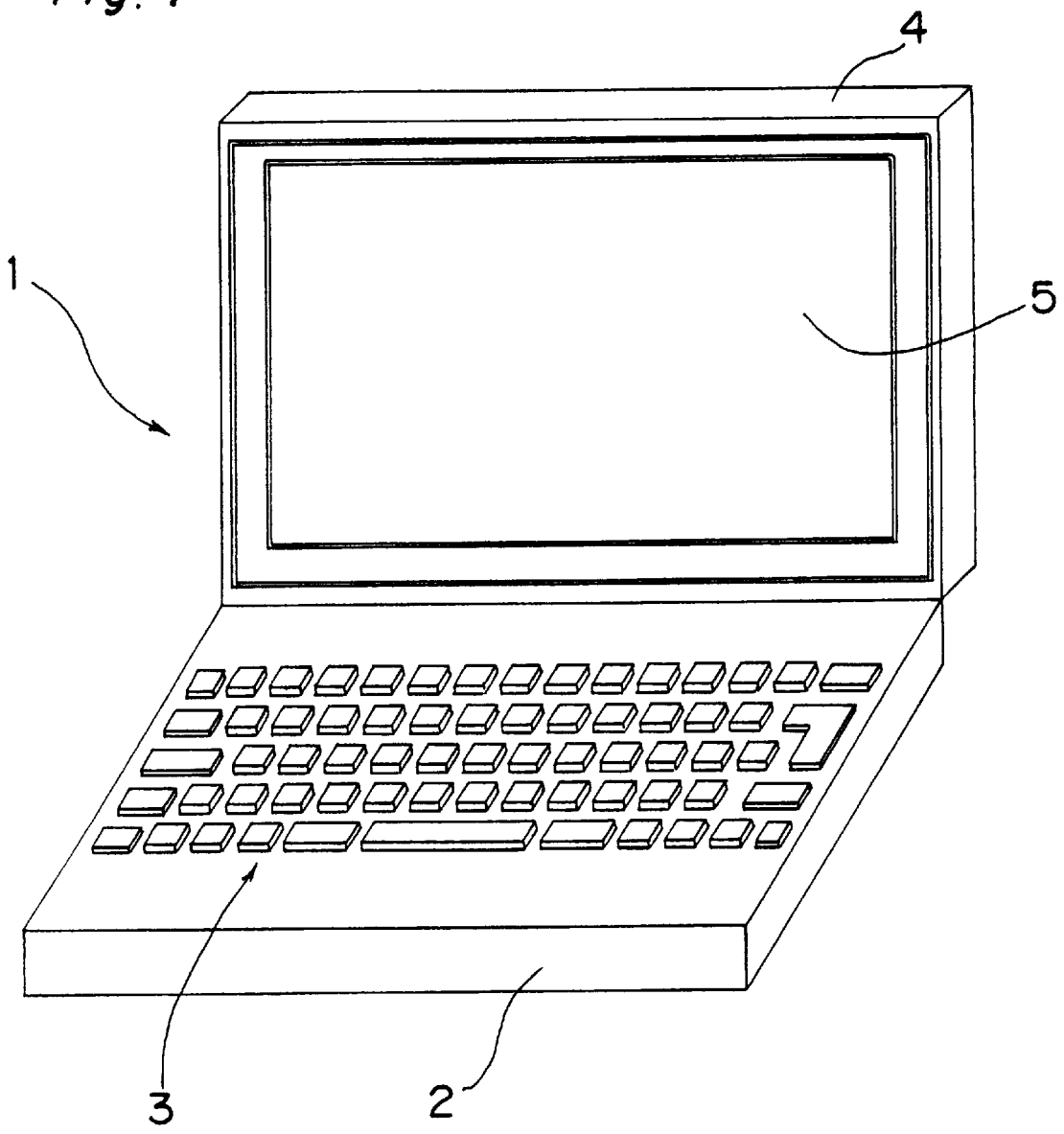
FIG. 1 is a perspective view showing an example of a computer according to a first embodiment of the present invention.

FIG. 1 is a perspective view showing an example of a computer 1 according to a first embodiment of the present invention. As shown in this figure, the computer 1 is, for example, a portable notebook type, where a casing 2 of a main body is provided with an openable lid 4, the main body casing 2 is provided with a key input device 3 and the lid 4 is provided with a display section 5 provided with, for example, an LCD (Liquid Crystal Display) panel.

Figure 2:
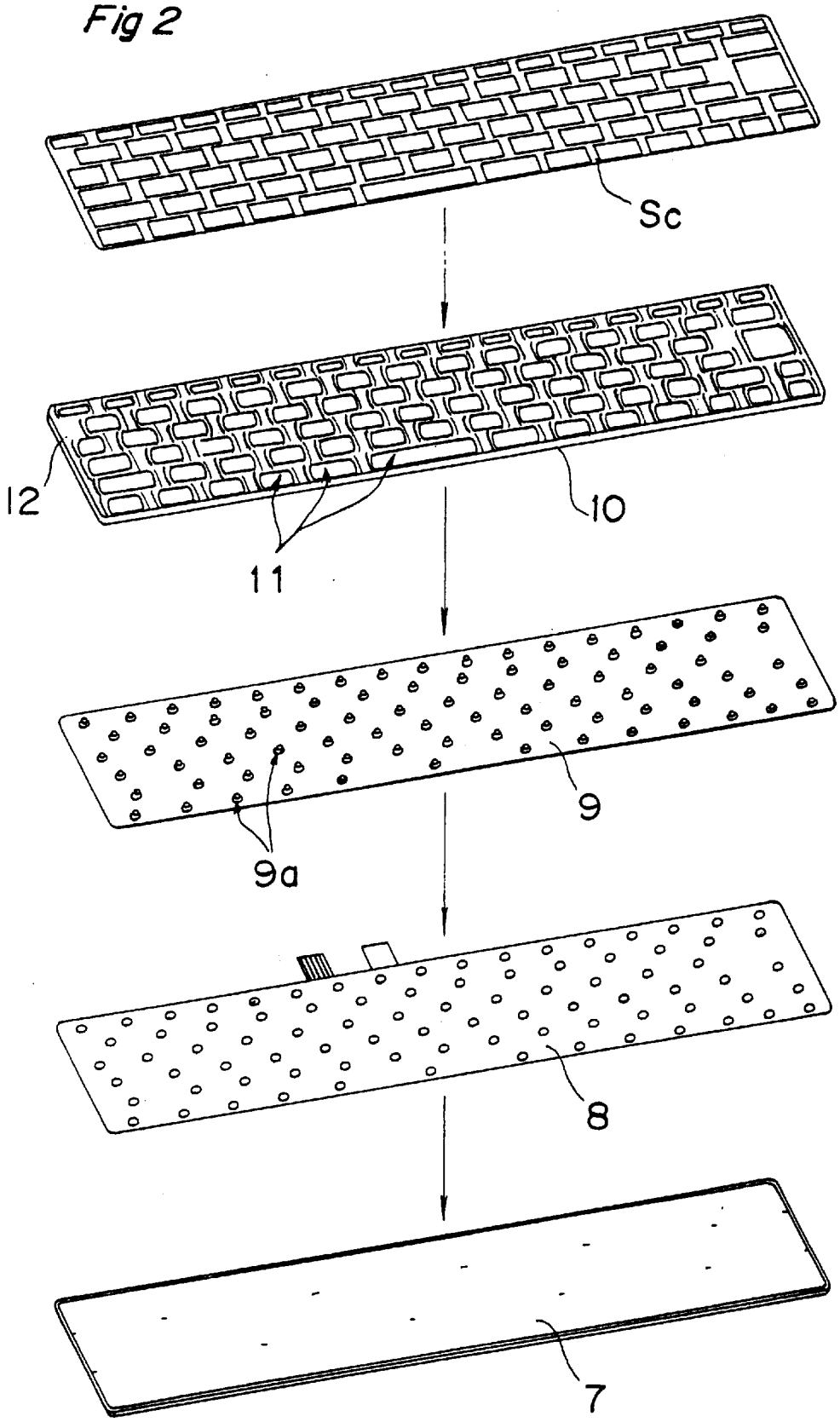
FIG. 2 is an exploded perspective view showing the construction of a key input device of the computer of the above first embodiment.

As clearly shown in FIG. 2, the key input device 3 is integrally formed by stacking in order a reinforcing plate 7, a membrane switch sheet 8, a click rubber 9 and an integrated type key top 10 and fixing them together by means of, for example, an adhesive.

The reinforcing plate 7 is made of, for example, a metal and is mounted on the upper surface side of the casing 2, producing a reinforcing effect on a key operating force applied to the key input device 3. In the present embodiment, as the reinforcing plate 7, for example, a plate which is made of aluminum and has a thickness of 0.8 [mm] was used.

Although not specifically shown, the membrane switch sheet 8 has a sectional structure similar to that of the conventionally well known one, where a spacer comprised of an electrically insulating layer is interposed between upper and lower electrode sheets except for a portion corresponding to the lower portion of the key top 11. By depressing the key top 11, the electrode sheet on the upper side (movable side) is pressed against the electrode sheet on the lower side (fixed side) supported on the reinforcing plate 7 via a click rubber 9 mentioned later, so that an electrical continuity is provided between both the electrodes.

The click rubber 9 is provided below the key top 11 (between the key top and the electric contact), and as described in more detail later, it serves as a contact pressing member for closing the electric contacts by pressing the electrode sheet on the upper side (movable side) against the electrode sheet on the lower side (fixed side) when the key top 11 is depressed and gives a sort of tactile feedback (click touch) to the depressing operation of the key top 11, and each key top 11 is placed on a projected portion 9*a* of the click rubber.

The integrated type key top 10 has a construction in which operating keys (key tops 11) corresponding to key symbols of letters, numbers, symbols and so on necessary for key input operation are arranged, and according to the present embodiment, all the key tops 11 are constructed as a key top form integrated with a frame portion 12 as described in detail later. The membrane sheet 8 and the click rubber 9 have approximately the same size as that of the key top form 10, and they are integrated, respectively.

It is acceptable to arrange a cover sheet Sc (decorative sheet) for covering only the frame portion 12 on the upper side of the key top form 10.

Figure 3:
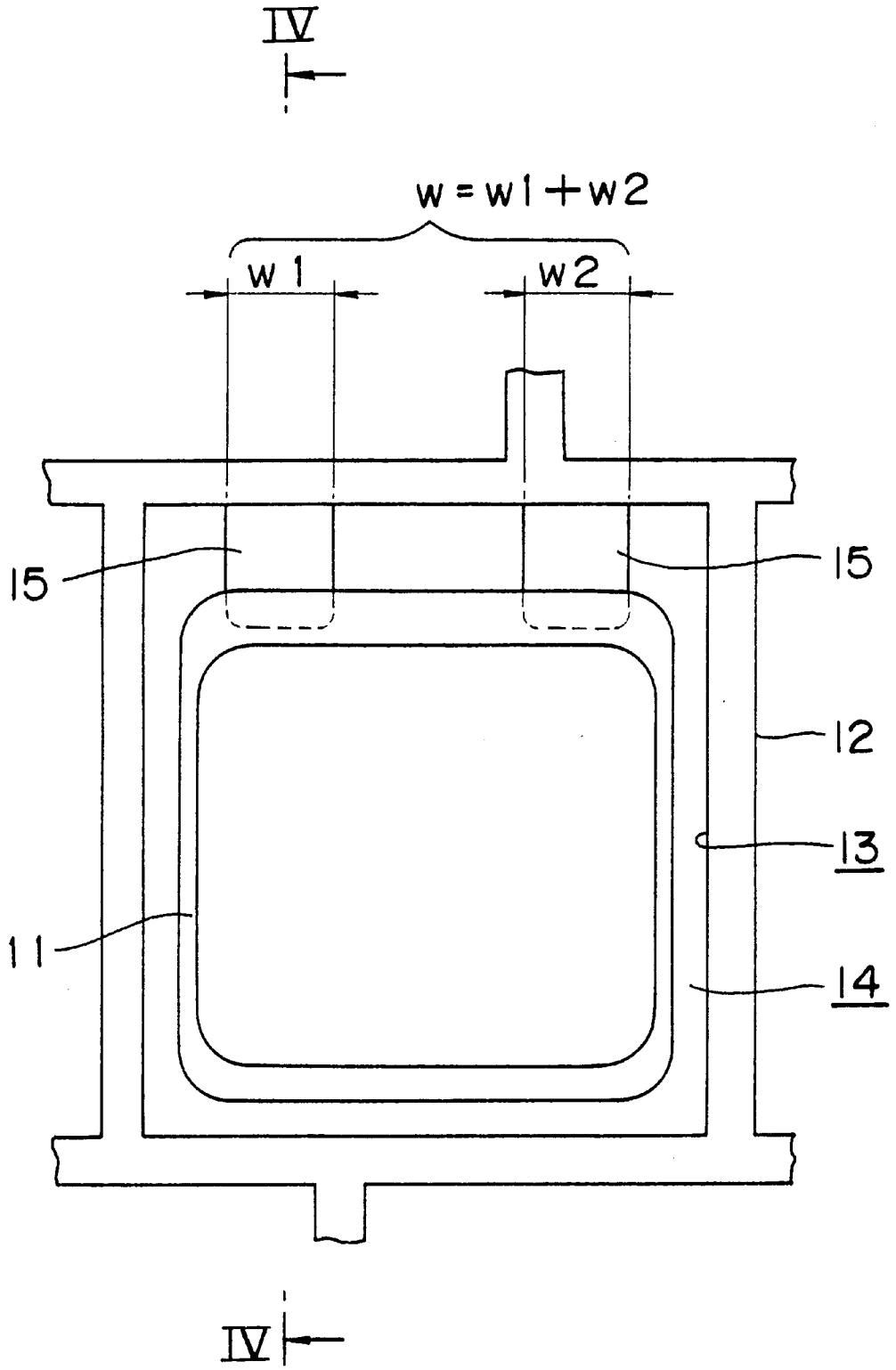
FIG. 3 is an explanatory plan view of a key top of the first embodiment.
Figure 4:
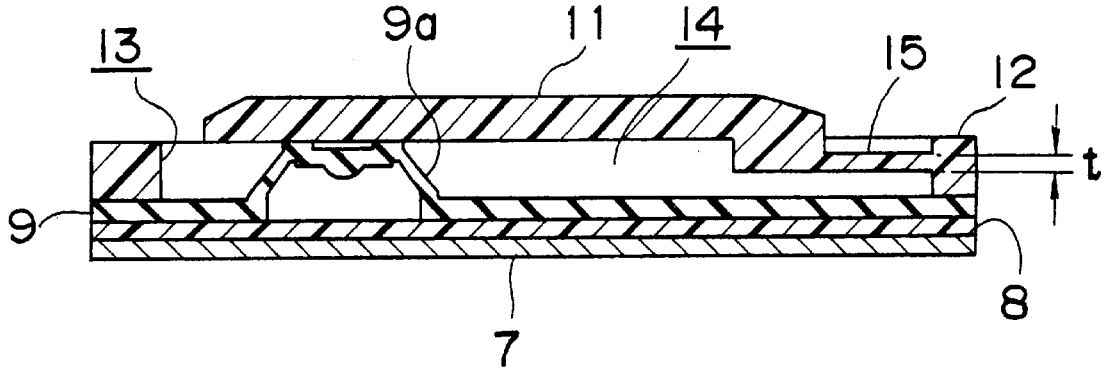
FIG. 4 is an explanatory longitudinal sectional view taken along the line IV—IV in FIG. 3.

As shown in FIG. 3 and FIG. 4, each key top 11 has an approximately rectangular shape as viewed from the top and is arranged inside an approximately rectangular-shaped opening section 13 in correspondence with the frame portion 12.

Figure 5:
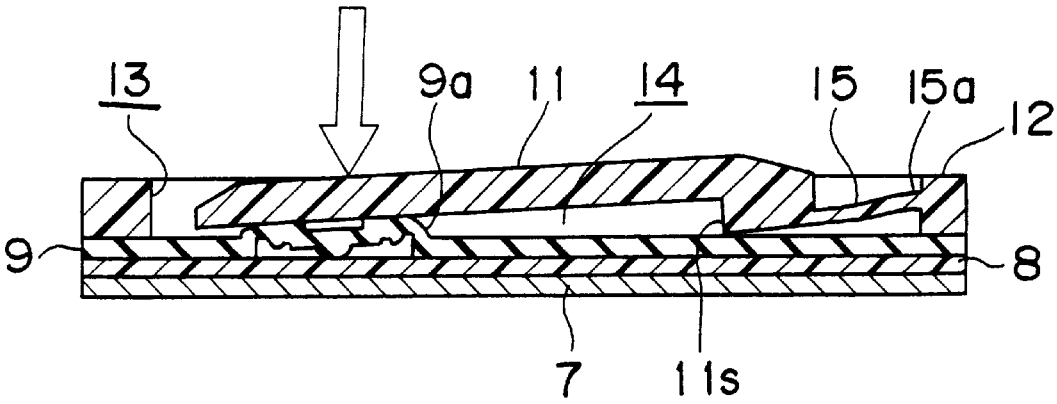
FIG. 5 is an explanatory longitudinal sectional view showing a state in which the key top of the first embodiment is depressed.

In the present embodiment, each key top 11 has in the vicinity of both the ends of its specified one side (the upper side in the example shown in FIG. 3) a portion connected to the frame portion 12 via a hinge portion 15 which extends in an approximately linear shape of a specified width and a specified thickness. When depressed as clearly shown in FIG. 5, the key top 11 pivots downward around a portion 15*a* of the hinge portion 15 and is fixed to the frame portion 12, thereby executing a flexural motion as an operating key. In this key input operation stage, the pivoting movement of the key top 11 is regulated by making the lower surface of a base portion 11*s* of one side connected to the hinge portion 15 abut against the click rubber 9. That is, the base portion lis of the one side and the click rubber 9 constitute a stopper mechanism.

In regard to all the key tops 11 of the present embodiment, the key tops 11, the hinge portion 15 and the frame portion 12 are molded as an integrated body (key top form 10) made of a specified resin material. As this resin material, for example, ABS (Acrylonitrile-Butadiene-Styrene) resin was used in the present embodiment.

As a material of the click rubber 9, for example, silicone rubber having a hardness (Shore hardness) of about 50 degrees was used. Then, for the adhesion of this click rubber 9 to the key top form 10 (specifically for the adhesion of the lower surface of the frame portion 12 of the key top form 10 to the upper surface of the click rubber 9), for example, a double sided adhesive tape (for example, No. 5302A produced by NITTO DENKO CORP.) was adopted. Otherwise, they can be assembled by thermal caulking.

The resin material of the key top form 10 was selected mainly on the criteria that it physically has a high fatigue strength (durability) and a relatively low bend elastic coefficient (small hinging power). Specifically, the material was selected with the following physical properties serving as the criteria.

a) fatigue limit (to a repetition of $10^7$ times of bending): 1.5 to 2.0 [kg/mm$^2$]

b) bend elastic coefficient: 100 to 200 [kg/mm$^2$]

As a resin material satisfying these two physical properties, there can be enumerated nylon resin (in particular, a mixture of nylon and ABS, a material obtained by incorporating an inorganic material such as glass fiber into nylon and the like), vinyl chloride resin (in particular, a material obtained by blending ABS resin, nitrile rubber and the like) or polypropylene resin besides the ABS resin.

An example of the molding method and molding conditions of the key top form 10 using the ABS resin as a material will be described below.

Principal dimensions [mm] of the key top form: length×width×basic thickness 120×280×3

Cross section area (rectangular cross section area) dimension [mm] of hinge portion:

thickness t×width w=0.3=5 (first example), 0.4×4 (second example), 0.5×4 (third example)

It is to be noted that the width w is the sum total of widths w1 and w2 of two hinge portions 15.

Molding method: injection molding (using hot runner and cold runner)

Molding machine: injection molding machine (Model No. P165/75 produced by SUMITOMO HEAVY INDUSTRIES, LTD.)

Resin temperature: 180° C.

Mold temperature: 60° C.

Injecting pressure: 120 MPa (first example), 100 MPa (second example), 85 MPa (third example)

When a key input operation is executed by depressing the key top 11 as described above, a click touch as a tactile feedback accompanying the key input operation is required. This click touch is obtained by the buckling at the side wall portion constituting the projected portion 9*a* of the click rubber 9 as a result of an increase in operating load with the progress of the depressing operation of the key top 11 and consequent reach to a specified critical value. That is, a large flexure is suddenly caused by this buckling phenomenon of the side wall portion, consequently reducing the operating load, and this sudden reduction in operating load gives the operating feeling of a sort of click touch as a tactile feedback.

Figure 6:
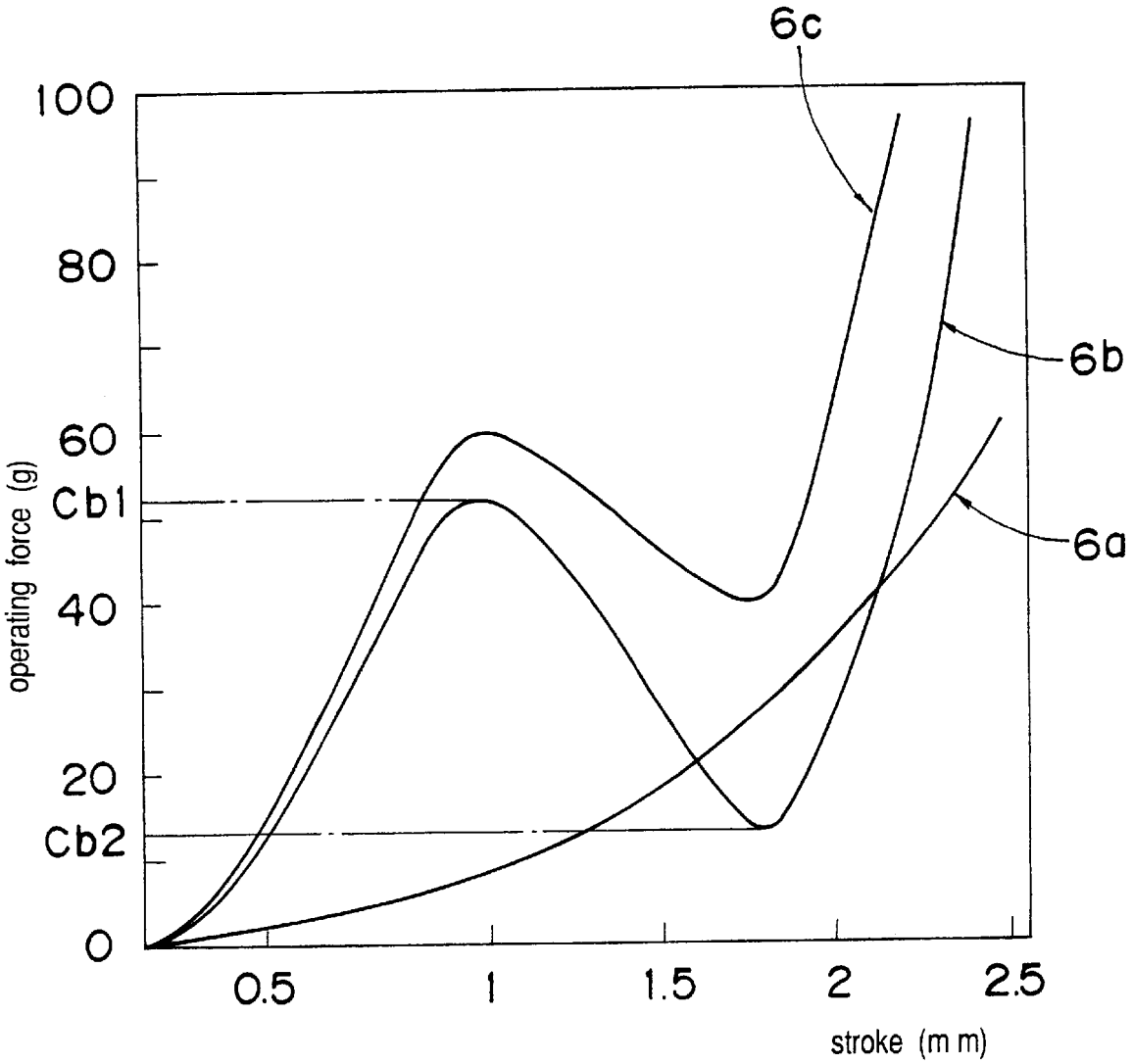
FIG. 6 is a graph showing an example of a click characteristic when the key top of the first embodiment is depressed.

FIG. 6 is a graph showing an example of a click characteristic in depressing the key top 11, where the curve 6*a* represents a characteristic of a change in operating force relative to a stroke when the key top 11 is solely depressed with no click rubber 9 arranged below it, the curve 6*b* represents a characteristic of a change in operating force relative to a stroke when the click rubber 9 is solely depressed (i.e., when the projected portion 9*a* of the click rubber 9 is directly depressed), and the curve 6*c* represents a synthetic characteristic of a change in operating force relative to a stroke when the key top 11 is depressed in the normal state (see FIG. 4 and FIG. 5) in which the click rubber 9 is arranged below.

As clearly shown in the graph of FIG. 6, when the click rubber 9 is not used (see the curve 6*a*), the operating force of the key top 11 increases as the stroke increases and does not temporarily reduce halfway. Therefore, in this case, no click touch can be obtained as a tactile feedback of the key operation.

When only the click rubber 9 is depressed (see the curve 6*b*), the operating force increases, and once the operating force reaches a peak value (maximum value: Cb1) with an increase in stroke, a great stroke is suddenly generated by the buckling phenomenon, reducing the operating force. When reaching a bottom value Cb2, the operating force increases as the stroke increases. Therefore, in this case, a click touch is generated as a tactile feedback of the key operation. In this case, a click ratio CR (a), which is an index representing the degree of the click touch, is calculated according to the following equation (1).

$$C_R[\%]=\{(Cb1-Cb2)/Cb1\}\times 100 \quad \ldots (1)$$

Such a temporary reduction in operating force when depressing the key top 11 is caused by the occurrence of the buckling phenomenon at the side wall portion constituting the projected portion 9*a* of the click rubber 9 as a consequence of the progress of the depressing operation as described above, and a varied click characteristic can be obtained depending on the shape, dimensions, material and so on of the click rubber 9.

In the case where the key top 11 is depressed in the normal state (see FIG. 4 and FIG. 5) in which the click rubber 9 is arranged below (see the curve 6*c*), the operating force becomes a synthetic force obtained by combining the force in the case where the key top is solely used (curve 6*a*) with the force in the case where the click rubber is solely used (curve 6*b*). This synthetic operating force also clearly exhibits a temporary reduction in operating force with the progress of the depressing operation. Eventually, a definite click touch was obtained although the click ratio was lower than in the case where the click rubber was solely used.

The present embodiment was set so that a click ratio $C_R$ of not smaller than 50% was preferably obtained, and at the time point when this click touch was generated, the reverse surface side of the projected portion 9*a* of the click rubber 9 was pressed against the membrane switch sheet 8 (see FIG. 5) thereby closing the electric contact.

A method for determining the basic dimensions of the longitudinal cross section of the hinge portion 15 will be described next.

In the present embodiment, a variety of samples having different dimensions with regard to the thickness t and width w of the hinge portions 15 were produced for the purpose of determining the optimum range of the thickness t and the width w of the hinge portions 15, and these samples are each subjected to a test of operating feeling and durability as the key top 11 in combination with the click rubber 9. It is to be noted that the width w is the sum total of the widths w1 and w2 of the two hinge portions 15 (w=w1+w2).

The material, basic dimensions and click rubber characteristics of the key tops (samples) subjected to this test are as follows.

Resin material used: ABS resin (molding conditions are as stated before).

Key top width dimension: 12 [mm]

Click rubber characteristics (of rubber used solely)

Peak load (Cb1 value in FIG. 6)=50 [g]

Click ratio $C_R$=70%

The test conditions of the durability test are as follows.

Testing device: keyboard durability tester (Model No. RA500 produced by Aiko Engineering Corp.)

Test load: 350 [g]

Test speed: two times per sec.

Test stroke: 10 [mm] (maximum)

Indenter: tip radius of curvature R=10 [mm];
Material: derlin

Judgement criteria:

It is decided that the operating life of durability expires when a switch malfunction or apparent abnormality is observed in operating the key top. Then, the sample was qualified as successful when exhibiting no abnormality after receiving 10 million repetitions of load application.

Further, in regard to the operating feeling, each sample was decided to have a bad feeling when a great force was required for depressing the key top and a heavy operating touch was felt.

When decided to have a bad feeling through this operating feeling test, when decided to have an expired operating life through the durability test, and when qualified as successful through the durability test, the sample was subjected to a measurement of the click ratio $C_R$.

Figure 7:
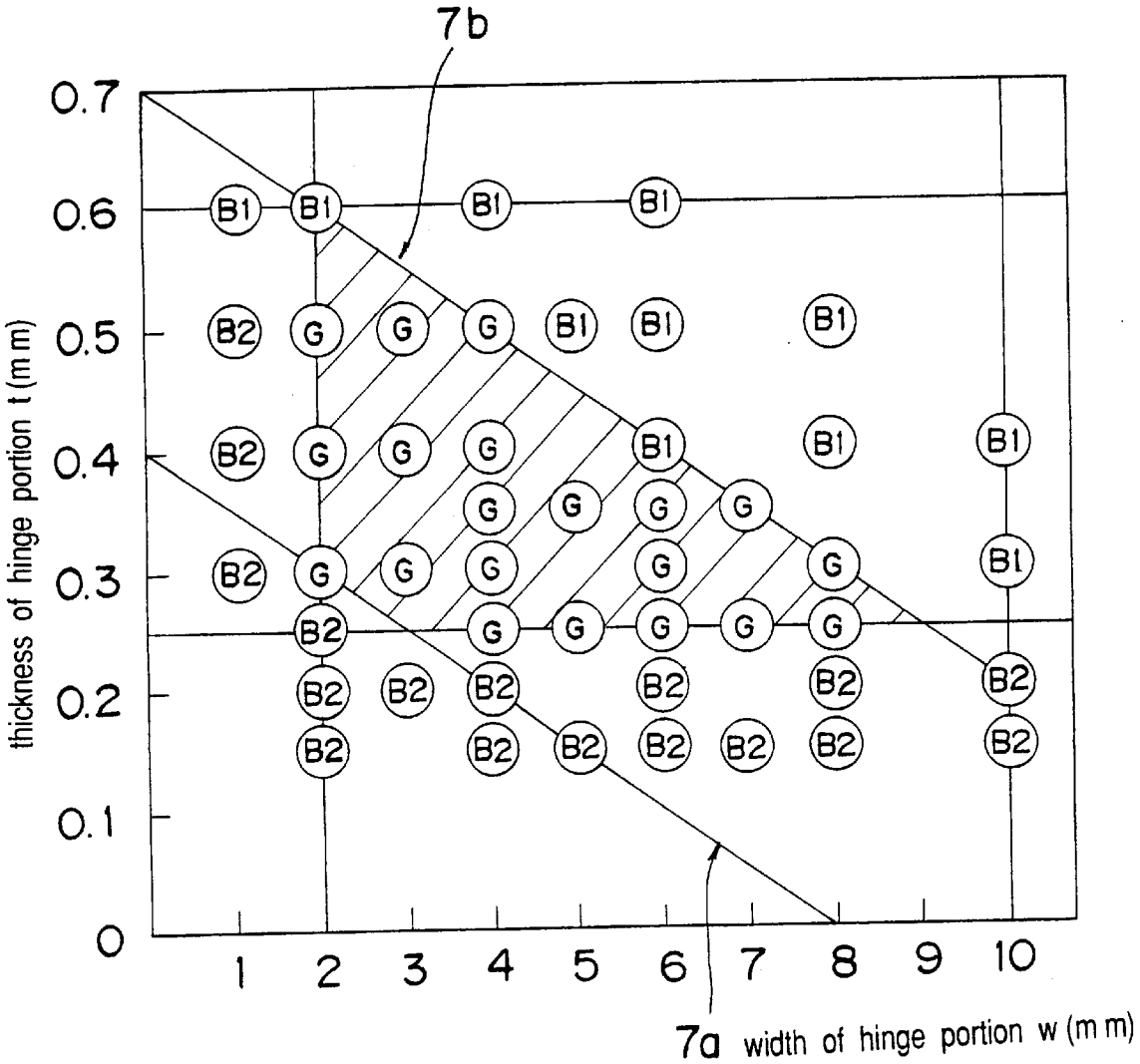
FIG. 7 is a graph showing optimum ranges of the thickness and width of the hinge portion of the key top of the first embodiment.

The test results are shown in the graph of FIG. 7. In FIG. 7, the mark G represents each one which has passed the durability test of 10 million times (107 times) and has a good operating feeling. In this case, the click ratio $C_R$ was not smaller than 50%. The mark B1 represents each one which has passed the durability test and has a bad operating feeling. In this case, the click ratio $C_R$ was smaller than 50%. Further, the mark B2 represents each one which has a good operating feeling (the click ratio $C_R$ being not smaller than 50% in this case) and exhibits an abnormality through the durability test.

From the graph of FIG. 7, in regard to the thickness t of the hinge portion 15, the operating feeling was good and a click ratio $C_R$ of not smaller than 50% was assured, whereas insufficient durability was obtained when the thickness was smaller than 0.25 [mm]. This case includes those which have a bad molding ability because of a small hinge thickness and those whose operating lives have expired in an early stage attributed to a shortage of absolute strength even though they can be molded without any trouble. When the thickness t exceeds 0.6 [mm], the durability is sufficient, whereas the operating feeling is bad.

In regard to the width w of the hinge portions 15, the operating feeling was good and a click ratio $C_R$ of not smaller than 50% was assured, whereas no sufficient durability was able to be obtained when the width was smaller than 2 [mm]. When the width w exceeds 10 [mm], the durability is sufficient, whereas the operating feeling is bad.

Therefore, the thickness t and the width w of the hinge portions 15 are required to be set within a range of $0.25 \leqq t \leqq 0.6$ and $2 \leqq w \leqq 10$.

Furthermore, even within the above-mentioned range, a satisfactory result was not able to be obtained with regard to both the operating feeling and the durability depending on a combination of the thickness t and the width w. That is, only when the combination of both the dimensions of the thickness t and the width w was in the region between the straight line 7*a* and the straight line 7*b* in FIG. 7, a satisfactory result was obtained with regard to both the operating feeling and the durability.

In the region above the straight line 7*b*, the durability is sufficient, whereas the operating feeling is bad. In the region below the straight line 7*a*, the operating feeling was good and a click ratio $C_R$ of not smaller than 50% was assured, whereas no sufficient durability was able to be obtained.

The straight line 7*a* and the straight line 7*b* can be expressed by the following equations (2) and (3), respectively.

$$\textit{Straight line 7a: } w+20t-8=0 \quad \ldots (2)$$

$$\textit{Straight line 7b: } w+20t-14=0 \quad \ldots (3)$$

Therefore, it was found proper to set the thickness t and the width w of the hinge portions 15 so as to satisfy all the following conditions for the purpose of obtaining a satisfactory result with regard to both the operating feeling and the durability. This corresponds to the hatched region shown in FIG. 7. Then, in the present first embodiment, the dimensional setting of the hinge portion 15 was performed based on these conditions.

$$\text{Range of thickness t [mm]: } 0.25 \leqq t \leqq 0.6 \quad \ldots (4)$$

$$\text{Range of width w [mm]: } 2 \leqq w \leqq 10 \quad \ldots (5)$$

Combination of thickness t and width w:

$$8 \leqq 20t+w \leqq 14 \quad \ldots (6)$$

Furthermore, the key top form 10 was formed of a material other than the aforementioned ABS resin, or a material satisfying the aforementioned standard physical property values of material selection (fatigue limit: 1.5 to 2.0 [kg/mm$^2$]; bend elastic coefficient: 100 to 200 [kg/mm$^2$]) enumerated as nylon resin (in particular, a mixture of nylon and ABS, a material obtained by incorporating an inorganic material such as glass fiber into nylon and the like), vinyl chloride resin (in particular, a material obtained by blending ABS resin, nitrile rubber and the like) and polypropylene resin, and these materials were subjected to a test of operating feeling and durability similar to the above. Each material exhibited a tendency similar to that of the ABS resin and approximately identical numerical ranges. Furthermore, other resin materials of, for example, polycarbonate resin, acrylic resin, polyethylene resin exhibited a tendency similar to that of the ABS resin.

Furthermore, supposing a large-size key of the so-called space key or the like, a key top 11 whose width had been changed to 40 [mm] was subjected to the test of operating feeling and durability similar to the above and exhibited a tendency similar to that of the aforementioned key top having a width of 12 [mm] with a similar numerical range obtained.

The aforementioned key input device 3 was assembled with the key top form 10 in which the thickness t and width w of the hinge portions 15 were set as described above (see FIG. 2). With this arrangement, a hinge type thinly configured key input device which can be assembled relatively easily and is optimally designed with regard to the required conditions of the hinge portion strength, durability, operability and so on was able to be obtained.

The aforementioned portable computer 1 was assembled with this key input device 3 (see FIG. 1). With this arrangement, the computer was able to be further reduced in thickness.

As described above, according to the present embodiment, each key top 11 is pivotally connected to the peripheral frame portion 12 via the hinge portion 15, and therefore, the space below the key top 11 (i.e., the space between it and the electric contact) can be made more compact in comparison with the one utilizing the conventional guide mechanism or pantograph mechanism, thereby allowing the key input device 3 to be further reduced in thickness.

In this case, the hinge portion 15 is provided in the vicinity of both the ends of the specified side of the key top 11, and therefore, even when a key input operating force is effected on an end portion displaced in he hinge width direction from the center portion of the key top 11 (in the case of so-called one-sided depressing), the other side end can be prevented from being lifted by the torsional deformation of the hinge portion 15, so that the possible occurrence of uneasy closing of the electric contact can be prevented. That is, the reliability of the switch operation with respect to the variation in effecting position of the operating force can be improved in comparison with the case where the hinge portion is provided in the center portion of a specified side of the key top.

Furthermore, the hinge portion 15 is provided only in the vicinity of both the ends of the specified side of the key top 11, and therefore, the hinge portion can be set to have a great thickness without causing an increase in key input operating force in comparison with the case where the hinge portion is provided throughout the entire width of the aforementioned side, thereby allowing the strength (absolute strength) of the hinge portion to be increased. Consequently, the hinge portion 15 can be prevented from being damaged by the effect of a key input operating force in, for example, the transverse direction or a diagonal direction, which is not normally supposed. Furthermore, the molding ability is improved.

Furthermore, in regard to the plurality of key tops 11, there is the arrangement of integrating the key tops 11, the hinge portion 15 and the frame portion 12 with one another with a resin material. This arrangement does not require many processes nor works in the manufacturing and assembling stages in contrast to the case where a key top and the peripheral frame portion which are formed separately from each other are assembled by being connected by a hinge, so that the key top can be easily incorporated into the key input device 3, allowing the manufacturing cost to be reduced.

Furthermore, the thickness t (mm) and the total width w (mm) of the hinge portion 15 are set so that $8 \leqq 20t+w \leqq 14$ is satisfied in the range of $0.25 \leqq t \leqq 0.6$ and $2 \leqq w \leqq 10$. With this arrangement, when the hinge portion 15, the key top 11 and the frame portion 12 are integrated with one another and made of a resin material, durability (fatigue strength) for long-term use can be assured with the operability in the key input operation satisfactorily maintained.

Furthermore, the aforementioned key top form 10 is incorporated into the key input device 3. With this arrangement, a hinge type thinly configured key input device which can be assembled relatively easily and is optimally designed with regard to the required conditions of the hinge portion strength, durability, operability and so on can be obtained.

The aforementioned portable computer 1 is assembled with this key input device 3. With this arrangement, the computer can be further reduced in thickness.

(Second Embodiment)

A second embodiment of the present invention will be described next. It is to be noted that the same components as those of the aforementioned first embodiment are denoted by the same reference numerals in the following description, and no further description will be provided for them.

Figure 8:
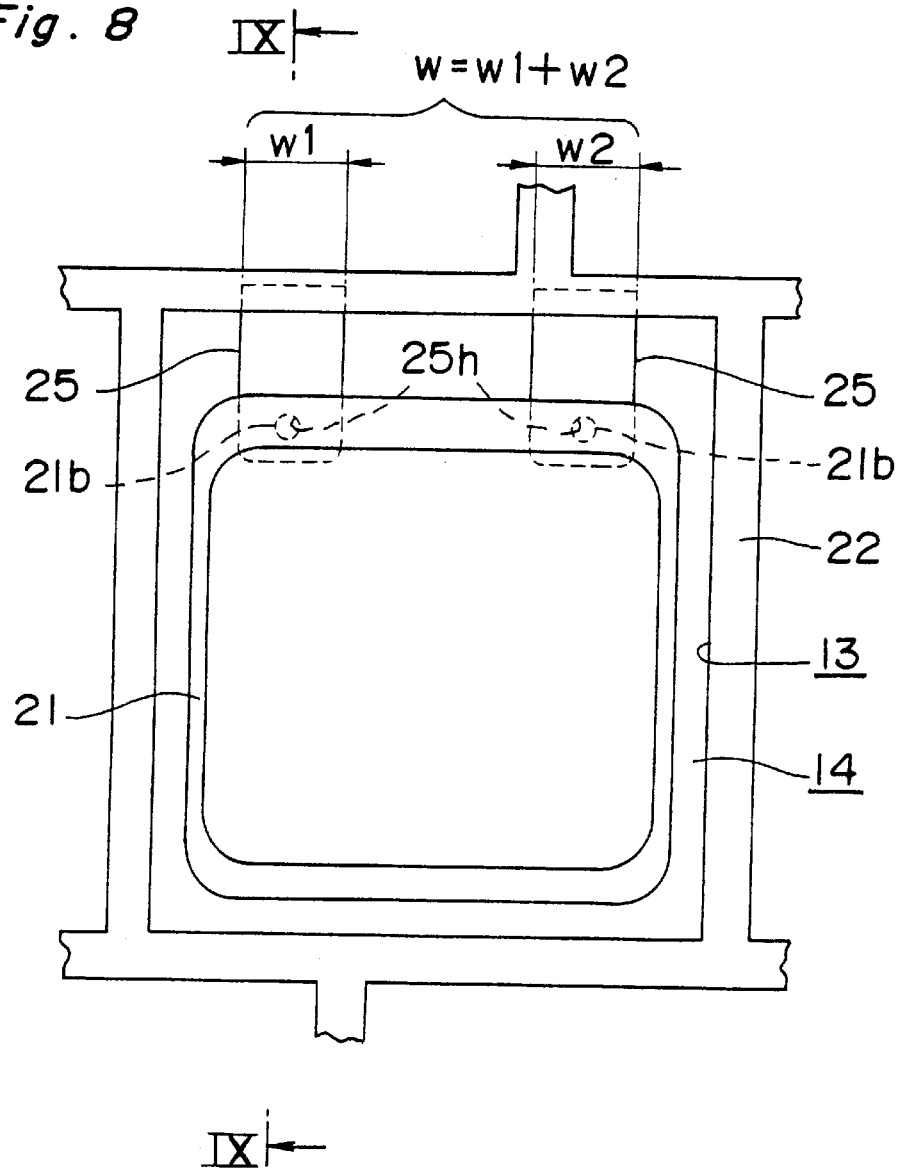
FIG. 8 is an explanatory plan view of a key top according to a second embodiment of the present invention.
Figure 9:
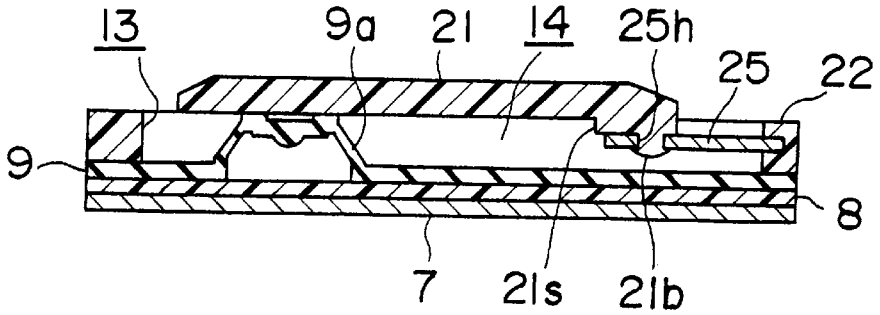
FIG. 9 is an explanatory longitudinal sectional view taken along the line IX—IX in FIG. 8.

In the present embodiment, as shown in FIGS. 8 and 9, hinge portions 25 connected in the vicinity of both the ends of a specified one side (the upper side in FIG. 8) of the key top 21 are originally formed separately from a key top 21 and a peripheral frame portion 22. In the present embodiment, as a material of this hinge portion 25, a metal sheet material of, for example, a phosphor bronze sheet material described in JIS C5210 was used.

Then, the phosphor bronze sheet material set to have a specified thickness and a specified width was set in a specified portion inside a mold and subjected to so-called insert molding with, for example, ABS resin, thereby integrating the key top 21 with the hinge portion 25 and the frame portion 22. It is to be noted that a hole portion 25*h* of a specified diameter is provided in the vicinity of end portions on one end side of the insert material (phosphor bronze sheet material) to be used for the hinge portion 25, and this hole portion 25*h* is set in the mold so as to be positioned on the reverse surface side of a base portion 21*s* of the one side of the key top 21 in a molding state.

With this arrangement, the hinge portion 25 has its one end fixed by a projecting portion 21*b* which penetrates the hole portion 25*h* on the reverse surface side of the base portion 21*s* of the one side, and the key top 21 and the frame portion 22 are connected to each other with the other end inserted in the frame portion 22.

A method for determining the basic dimensions of the longitudinal cross section of the hinge portion 25 will be described next.

In the present embodiment, a test of operating feeling and durability was performed similar to the case of the first embodiment with the thickness t and the width w of the hinge portions 25 changed in a variety of ways for the purpose of determining the optimum range of the thickness t and the width w (w=w1+w2) of the hinge portion 25.

The material, basic dimensions, click rubber characteristics of the key tops (samples) subjected to this test as well as the testing device, conditions, deciding method and so on of the test of operating feeling and durability were similar to those of the first embodiment.

Figure 10:
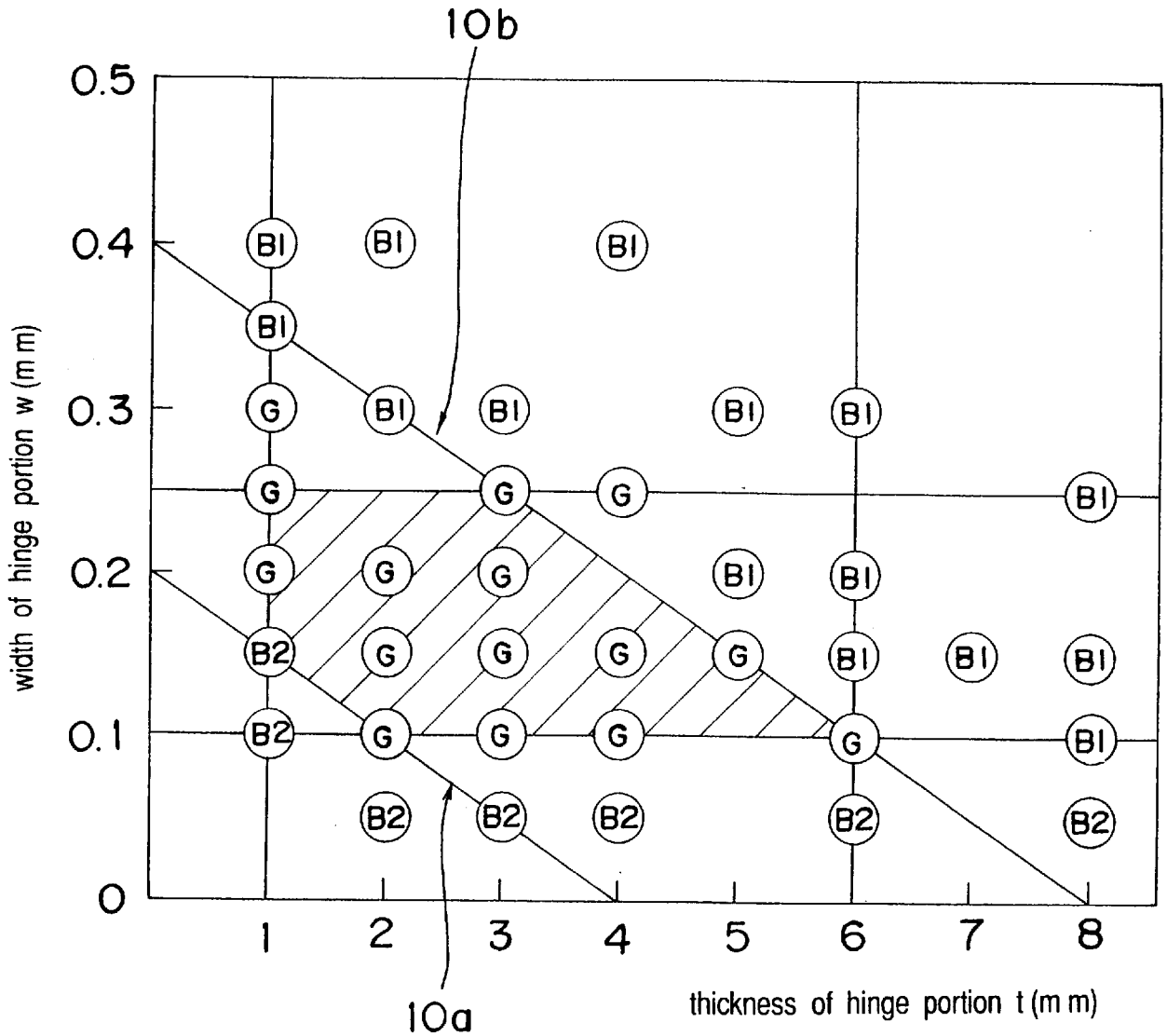
FIG. 10 is a graph showing optimum ranges of the thickness and width of the hinge portion of the key top of the second embodiment.

The test results are shown in the graph of FIG. 10. The marks G, B1 and B2 shown in FIG. 10 represent the results similar to those of the first embodiment.

From the graph of FIG. 10, in regard to the thickness t of the hinge portion 25, the operating feeling was good and a click ratio $C_R$ of not smaller than 50% was assured, whereas insufficient durability was obtained when the thickness was smaller than 0.1 [mm]. When the thickness t exceeds 0.25 [mm], the durability is sufficient, whereas the operating feeling is bad.

In regard to the width w of the hinge portions 25, the hinge width is too narrow to assure strength and the handling of the hinge portion becomes extremely bad when the width is smaller than 1 [mm]. It is to be noted that a satisfactory result was exhibited when the thickness t was within a specified range at this lower limit. When the width w exceeds 6 [mm], the durability is sufficient, whereas the operating feeling is bad.

Therefore, in regard to the thickness t and the width w of the hinge portions 25, they are required to be set within a range of $0.5 \leqq t \leqq 0.25$ and $1 \leqq w \leqq 6$.

Furthermore, even within the above-mentioned range, a satisfactory result was not able to be obtained with regard to both the operating feeling and the durability depending on a combination of the thickness t and the width w. That is, only when the combination of both the dimensions of the thickness t and the width w was in the region between the straight line 10*a* and the straight line 10*b* shown in FIG. 10, a satisfactory result was obtained with regard to both the operating feeling and the durability. In the region above the straight line 10*b*, the durability is sufficient, whereas the operating feeling is bad. In the region below the straight line 10*a*, the operating feeling was good and a click ratio $C_R$ of not smaller than 50% was assured, whereas no sufficient durability was able to be obtained.

The straight line 10*a* and the straight line 10*b* can be expressed by the following equations (7) and (8).

$$\textit{Straight line 10a: } w+20t-4=0 \quad \ldots (7)$$

$$\textit{Straight line 10b: } w+20t-8=0 \quad \ldots (8)$$

Therefore, it was found proper to set the thickness t and the width w of the hinge portions 25 so as to satisfy all the following conditions for the purpose of obtaining a satisfactory result with regard to both the operating feeling and the durability. This corresponds to the hatched region shown in FIG. 10. Then, in the present second embodiment, the dimensional setting of the hinge portion 25 was performed based on these conditions.

Range of thickness t [mm]: $0.1 \leqq t \leqq 0.25$ . . . (9)

Range of width w [mm]: $1 \leqq w \leqq 6$ . . . (10)

Combination of thickness t and width w:

$4 \leqq 20t+w \leqq 8$ . . . (11)

Furthermore, the hinge portion 25 was formed of a variety of metal sheet materials of, for example, a spring steel described in JIS G4801 or a stainless steel (for example, sUS304) described in JIS G4307 and the like, besides the aforementioned phosphor bronze, and these materials were subjected to a test of operating feeling and durability similar to the above. Each material exhibited a tendency similar to that of the phosphor bronze. Furthermore, supposing a large-size key of the so-called space key or the like, a key top 11 whose width had been changed to 40 [mm] was subjected to a test of operating feeling and durability similar to the above and exhibited a tendency similar to that of the aforementioned key top having a width of 12 [mm] with a similar numerical range obtained.

As described above, according to the present embodiment, effects similar to those of the first embodiment can be produced with regard to a further reduction in thickness of the key input device 3, the improvement of the reliability of the switch operation with respect to a variation in effecting position of the operating force, the incorporation of the key top form into the key input device 3 and the assembling of the computer 1 provided with the key input device 3.

Furthermore, the hinge portion 25 is formed of a metal sheet material in this case, and therefore, a material having superior mechanical and physical properties to those of the key top 21 and the peripheral frame portion 22 can be used for the hinge portion 25, so that the strength (absolute strength) and durability (fatigue strength) of the hinge portion 25 can be improved in comparison with the case where these members are formed of an identical material. On the other hand, the hinge portion 25 is provided only in the vicinity of both the ends of the specified side of the key top 21, and therefore, the hinge portion 25 can be set to have a great thickness without causing an increase in key input operating force in comparison with the case where the hinge portion is provided throughout the entire width of the aforementioned one side, thereby allowing the strength (absolute strength) of the hinge portion 25 to be increased. Consequently, the hinge portion 25 can be prevented from being damaged by the effect of a key input operating force in, for example, the transverse direction or a diagonal direction, which is not normally supposed. Furthermore, the handling in setting the hinge portion 25 (sheet material made of metal) between the key top 21 and the frame portion 22 in the manufacturing stage is also improved.

Furthermore, in regard to a plurality of key tops 21, there is an arrangement of integrating the key tops 21, the hinge portion 25 and the frame portion 22 with one another. This arrangement does not require many processes nor works in the manufacturing and assembling stages in contrast to the case where a key top and the peripheral frame portion which are formed separately from each other are assembled together by being connected by a hinge, so that the key top can be easily incorporated into the key input device 3, allowing the manufacturing cost to be reduced.

Furthermore, the hinge portion 25 is made of a metal sheet material and its thickness t (mm) and total width w (mm) are set so that $4 \leqq 20t+w \leqq 8$ is satisfied in the range of $0.1 \leqq t \leqq 0.25$ and $1 \leqq w \leqq 6$. With this arrangement, when the hinge portion 25 made of the metal sheet material is integrated with the key top 21 and the frame portion 22, durability (fatigue strength) for a long-term use can be assured with the operability in the key input operation satisfactorily maintained.

(Third Embodiment)

A third embodiment of the present invention will be described next.

Figure 11:
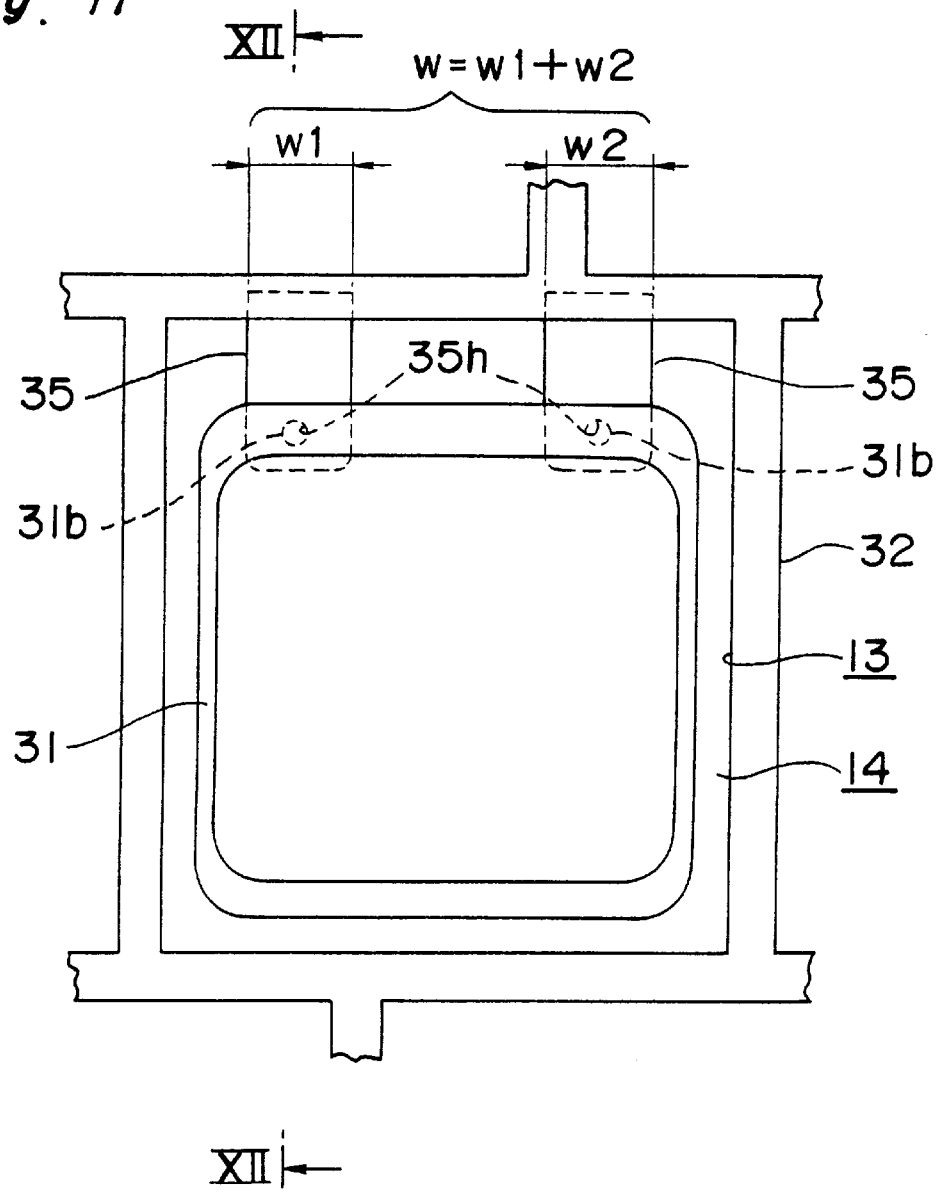
FIG. 11 is an explanatory plan view of a key top according to a third embodiment of the present invention.
Figure 12:
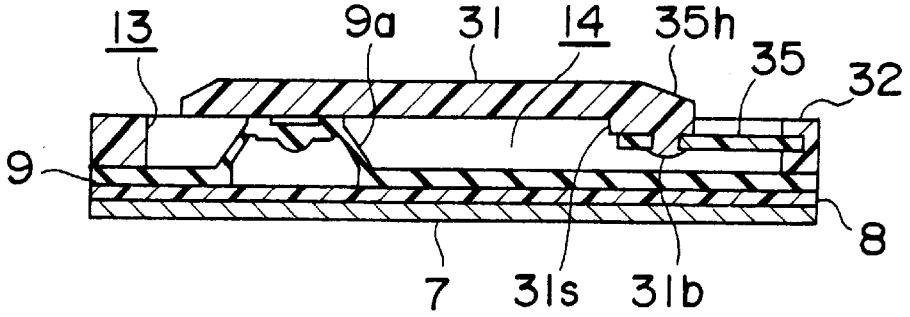
FIG. 12 is an explanatory longitudinal sectional view taken along the line XII—XII in FIG. 11.

According to the present embodiment, as shown in FIG. 11 and FIG. 12, hinge portions 35 connected in the vicinity of both the ends of a specified side (the upper side in FIG. 11) of a key top 31 are originally formed separately from the key top 31 and a peripheral so frame portion 32 similar to the case of the second embodiment. In the present embodiment, as a material of this hinge portion 35, a resin sheet material of, for example, a PET resin was used.

Then, the PET resin sheet material set to have a specified thickness and a specified width was set in a specified portion inside a mold and subjected to the so-called insert molding with, for example, ABS resin, thereby integrating the key top 31 with the hinge portion 35 and the frame portion 32. It is to be noted that a hole portion 35*h* of a specified diameter is provided in the vicinity of the end portions on one end side of the insert material (PET resin sheet material) to be used for the hinge portion 31 similar to the case of the second embodiment, and this hole portion 35*h* is set in the mold so as to be positioned on the reverse surface side of a base portion 31*s* of the one side of the key top 31 in a molding state.

With this arrangement, the hinge portion 35 has its one end fixed by a projecting portion 31*b* which penetrates the hole portion 35*h* on the reverse surface side of the base portion 31*s* of the one side, and the key top 31 and the frame portion 32 are connected to each other with the other end inserted in the frame portion 32.

A method for determining the basic dimensions of the longitudinal cross section of the hinge portion 35 will be described next.

Also in the present embodiment, a test similar to those of the first and second embodiments was performed, and the optimum range of the thickness t and width w (w=w1+w2) of the hinge portion 35 was determined by a similar method.

Figure 13:
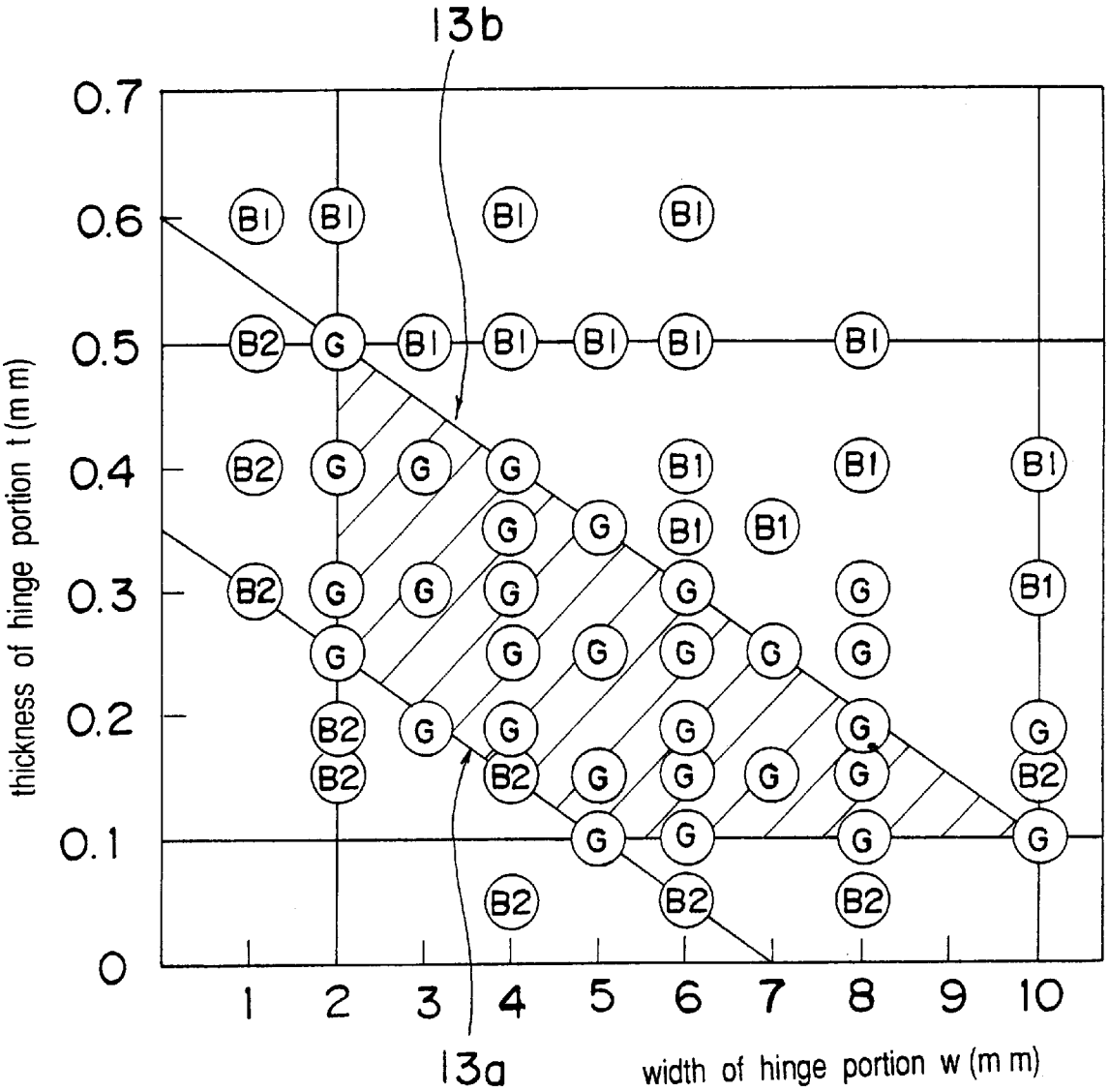
FIG. 13 is a graph showing optimum ranges of the thickness and width of the hinge portion of the key top of the third embodiment.

The test results are shown in the graph of FIG. 13. The marks G, B1 and B2 shown in FIG. 13 represent the results similar to those of the first and second embodiments.

From the graph of FIG. 13, in regard to the thickness t of the hinge portion 35, the operating feeling was good and a click ratio $C_R$ of not smaller than 50% was assured, whereas no insufficient durability was obtained when the thickness is smaller than 0.1 [mm]. This case includes those key tops whose operating lives have expired in an early stage attributed to a shortage in absolute strength because of the specifically small hinge thickness (0.05 [mm]). When the thickness t exceeds 0.5 [mm], the durability is sufficient, whereas the operating feeling is bad.

In regard to the width w of the hinge portions 35, the operating feeling was good and a click ratio $C_R$ of not smaller than 50% was assured, whereas no sufficient durability was able to be obtained when the width is smaller than 2 [mm]. When the width w exceeds 10 [mm] the durability is sufficient, whereas the operating feeling is bad.

Therefore, in regard to the thickness t and the width w of the hinge portions 35, they are required to be set within a range of $0.1 \leqq t \leqq 0.5$ and $2 \leqq w \leqq 10$.

Furthermore, even within the above-mentioned range, a satisfactory result was not obtained with regard to both the operating feeling and the durability depending on a combination of the thickness t and the width w. That is, only when the combination of both the dimensions of the thickness t and the width w was in the region between the straight line 13*a* and the straight line 13*b* in FIG. 13, a satisfactory result was obtained with regard to both the operating feeling and durability. In the region above the straight line 13*b*, the durability is sufficient, whereas the operating feeling is bad. In the region below the straight line 13*a*, the operating feeling was good and a click ratio $C_R$ of not smaller than 50% was assured, whereas insufficient durability was obtained.

The straight line 13*a* and the straight line 13*b* can be expressed by the following equations (12) and (13).

$$\textit{Straight line 13a: } w+20t-7=0 \quad \ldots (12)$$

$$\textit{Straight line 13b: } w+20t-12=0 \quad \ldots (13)$$

Therefore, it was found proper to set the thickness t and the width w of the hinge portions 35 so as to satisfy all the following conditions for the purpose of obtaining a satisfactory result with regard to both the operating feeling and the durability. This corresponds to the hatched region shown in FIG. 13. Then, according to the present third embodiment, the dimensional setting of the hinge portion 35 was performed based on these conditions.

$$\text{Range of thickness t [mm]: } 0.1 \leqq t \leqq 0.5 \quad \ldots (14)$$

$$\text{Range of width w [mm]: } 2 \leqq w \leqq 10 \quad \ldots (15)$$

Combination of thickness t and width w:

$$7 \leqq 20t+w \leqq 12 \quad \ldots (16)$$

A test of operating feeling and durability similar to the above was performed with the material of the hinge portion 35 replaced by, for example, a sheet material made of polycarbonate resin rather than the aforementioned sheet material made of PET resin, and it exhibited a tendency similar to that of PET resin. As a material of the hinge portion 35, in combination with the molding material (base material) of the key top 31 and the frame portion 32, it is acceptable to use a resin material having a higher melting temperature or a higher moldable temperature than those of this base material.

Furthermore, supposing a large-size key of the so-called space key or the like, a key top 11 whose width had been changed to 40 [mm] was subjected to a test of operating feeling and durability similar to the above, and it exhibited a tendency similar to that of the aforementioned key top having a width of 12 [mm] with a similar numerical range obtained.

As described above, the present embodiment is similar to the aforementioned second embodiment except that the material used for the hinge portion 35 is different, and it can basically produce a similar effect.

In particular, the hinge portion 35 is made of a sheet material made of resin and has a thickness t (mm) and a total width w (mm) set so that $7 \leqq 20t+w \leqq 12$ is satisfied in a range of $0.1 \leqq t \leqq 0.5$ and $2 \leqq w \leqq 10$. With this arrangement, when the hinge portion 35 comprised of the sheet material made of resin is integrated with the key top 31 and the frame portion 32, a durability (fatigue strength) for a long-term use can be assured with the operability in the key input operation satisfactorily maintained.

(Fourth Embodiment)

A fourth embodiment of the present invention will be described next. This fourth embodiment shows a modification example of the aforementioned second or third embodiment.

Figure 14:
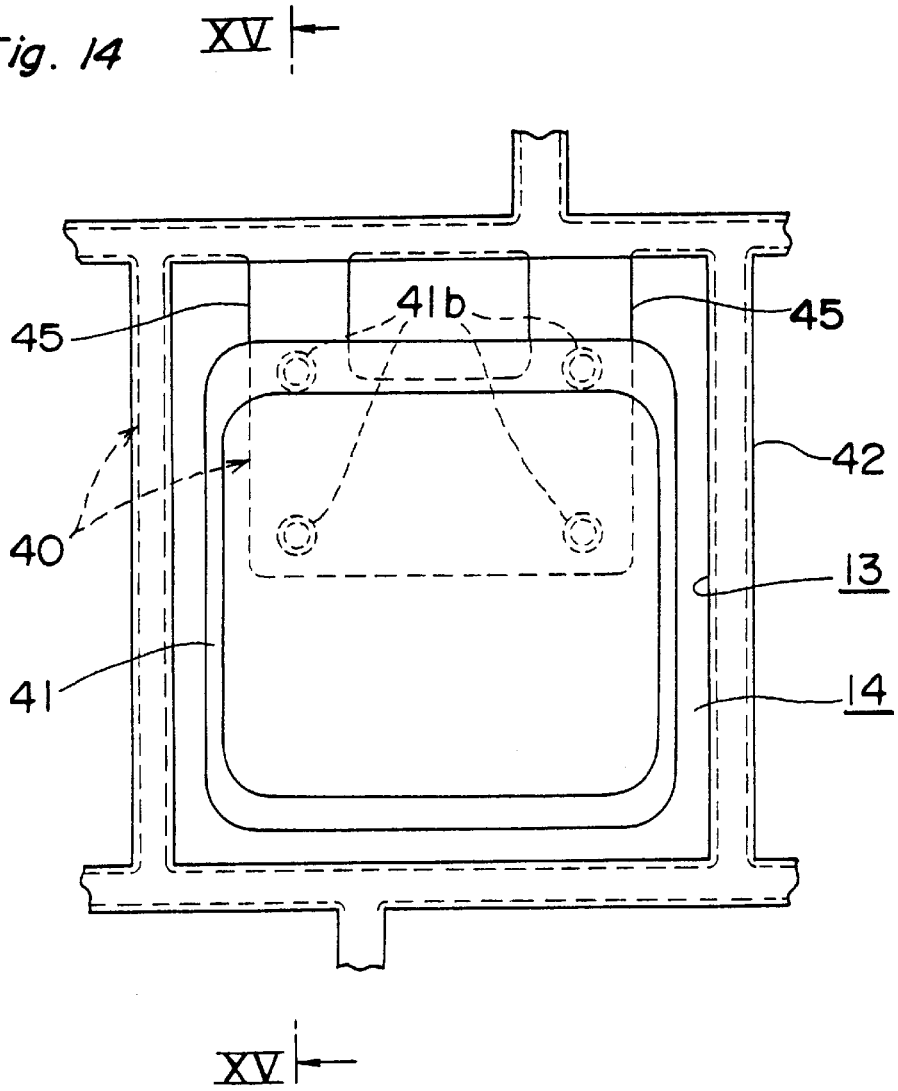
FIG. 14 is an explanatory plan view of a key top according to a fourth embodiment of the present invention.
Figure 15:
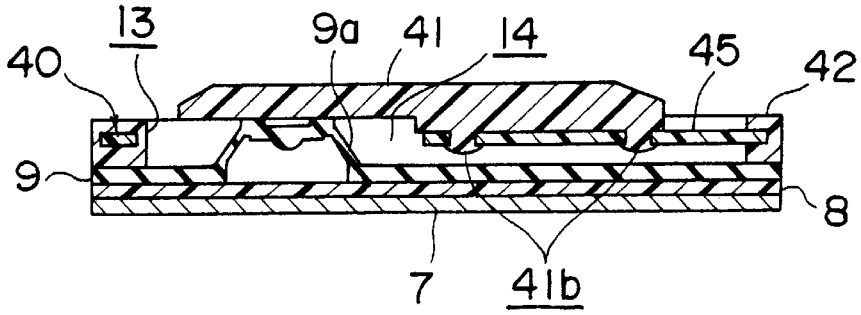
FIG. 15 is an explanatory longitudinal sectional view taken along the line XV—XV in FIG. 14.

In detail, when forming a hinge portion with a sheet material made of a metal or resin and integrating it with a key top and a frame portion by the insert molding, as shown in FIG. 14 and FIG. 15, a sheet material 40 is extended not only to a hinge portion 45 but also to a key top 41 and a frame portion 42, and such a sheet material 40 is positioned and set in the mold when subjected to the insert molding process.

In this case, the frame portion 42 is reinforced by the material having a higher strength provided inside. Furthermore, strength of connecting the frame portion 42 with the hinge portion 45 and strength of supporting the hinge portion 45 are also improved. Furthermore, in regard to the key top 41, the sheet material 40 is extended approximately to the center portion of the key top 41 and fixed on the four projecting portions 41*b*, and therefore, the strengths of connecting and supporting the key top 41 with the hinge portion 45 are improved.

(Fifth Embodiment)

A fifth embodiment of the present invention will be described next.

Figure 16:
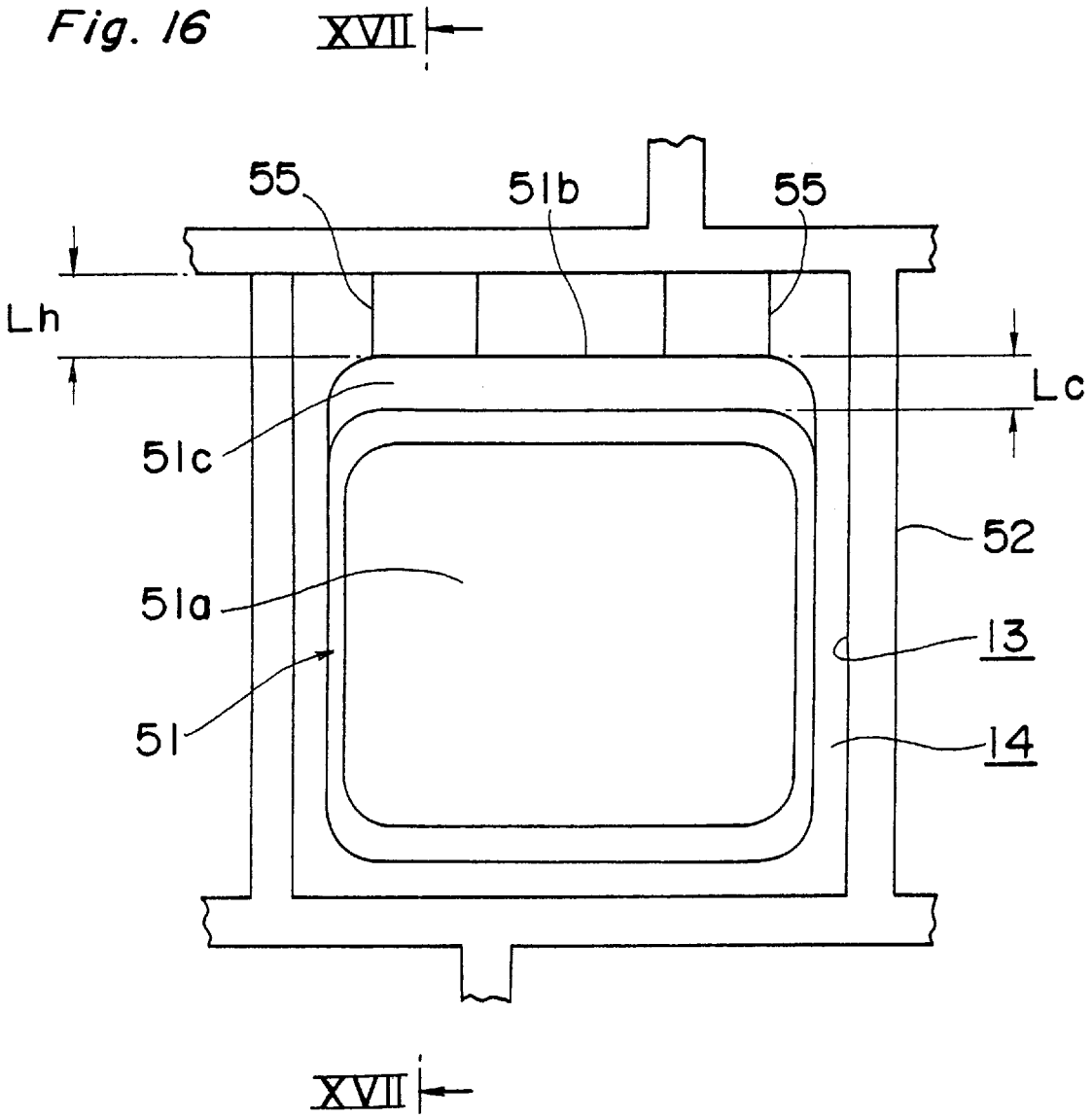
FIG. 16 is an explanatory plan view of a key top according to a fifth embodiment of the present invention.
Figure 17:
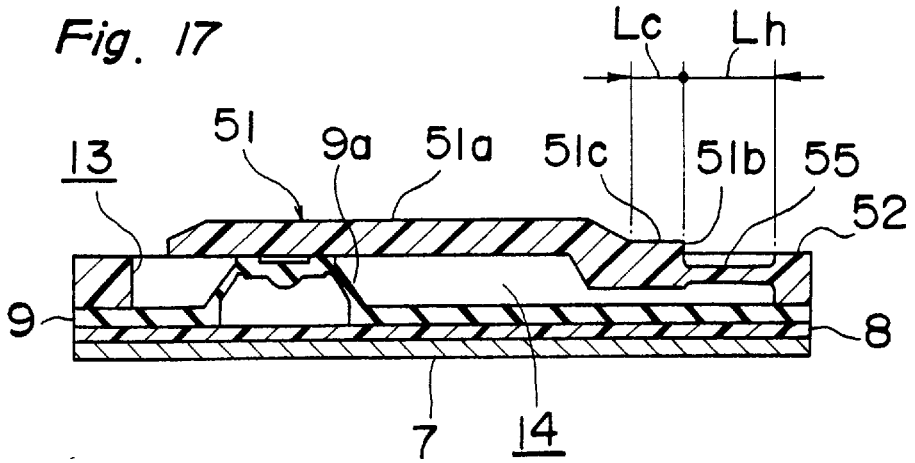
FIG. 17 is an explanatory longitudinal sectional view taken along the line XVII—XVII in FIG. 16.

In the present embodiment, as shown in FIG. 16 and FIG. 17, a lowered portion 51*c* which has a specified length and is set lower in level than a depressing operating portion 51*a* is provided between the depressing operating portion 51*a* and an end portion 51*b* connected to a hinge portion 55 of each key top 51. The length Lc of this lowered portion 51*c* is preferably set not smaller than one half the length L of the hinge portion 55.

As described above, in the present embodiment, the lowered portion 51*c* which has the specified length and is set lower in level than the depressing operating portion 51*a* is provided between the depressing operating portion 51*a* and the end portion 51*b* connected to the hinge portion 55 of each key top 51. Therefore, when performing a key input operation by depressing the key top 51, an operating force is hard to effect on this lowered portion 51*c*. With this arrangement, the point of action of the operating force can be separate from the end portion 51*b* connected to the hinge portion 55. As a result, this arrangement can effectively prevent the operating force required for closing the electric contact from increasing attributed to the separation of the point of action of the operating force from the approximate center portion of the depressing operating portion 51*a* toward the hinge portion 55 and prevent the effects of deteriorating the operability and applying an excessive stress on the hinge portion accompanying this.

It is to be noted that the present invention is not limited to the aforementioned embodiments, and it is a matter of course that a variety of improvements or changes in design can be achieved within the scope thereof, not departing from the essence thereof.

What is claimed is:

1. An integrated key top assembly comprising:

a plurality of key tops, each of the key tops having two pairs of opposing sides; and a frame connected to a first side of each of the key tops, the frame including respective first and second hinges extending substantially linearly from opposite ends of the first side of each of the key tops, pivotally connecting each of the key tops to the frame, wherein each of the first and second hinges has a thickness t (mm), each pair of first and second hinges has a total width w (mm), $8 \leqq 20t+w \leqq 14$ is satisfied for $0.25 \leqq t \leqq 0.6$ and $2 \leqq w \leqq 10$, and the plurality of key tops the first and second hinges, andl the frame coprise les article of the same resin materal.

2. An integrated key top assembly comprising:

a plurality of key top, each of the key tops having two pairs of opposing sides; and a metal frame connected to a first side of each of the key tops, the frame including respective first and second hinges extending snbstantially linearly from opposite ends of the first side of each of the key tops, pivotally connecting each of the key tops to the frame wherein each of the first and second hinges comprises a part of a metal sheet and each of the key tops comprises a resin.

3. The integrated key top assembly as claimed in claim 2, wherein each of the first and second hinges has a thickness t (mm), each pair of first and, second hinges has a total width w (mm), and $4 \leqq 20t+w \leqq 8$ is satisfied for $0.1 \leqq t \leqq 0.25$ and $1 \leqq w \leqq 6$.

4. The integrated key top assembly as claimed in claim 2, wherein each of the first and second hinges includes an opening and each of the resin key tops includes protrusions extending through the holes in and engaging a respective pair of the first and second hinges.

5. An integrated key top assembly comprising:

a plurality of key tops, each of the key tops having two pairs of opposing sides; and a resin frame connected to a first side of each of the key tops, the frame including respective first and second hinges extending substantially linearly from opposite ends of the first side of each of the key tops, pivotally connecting the key tops to the frame, wherein each of the first and second hinges comprises a first resin and each of the key tops comprises a second resin different from the first resin.

6. The integrated key top assembly as claimed in claim 5, wherein each of the first and second hinges has a thickness t (mm), each pair of first and second hinges has a total width w (mm), and $7 \leqq 20t+w \leqq 12$ is satisfied for $0.1 \leqq t \leqq 0.5$ and $2 \leqq w \leqq 10$.

7. The integrated key top assembly as claimed in claim 5, wherein each of the first and second hinges includes an opening and each of the key tops includes protrusions extending through the holes in and engaging a respective pair of the first and second hinges.

8. An integrated key top assembly comprising:

a plurality of key tops each of the key tops having two pairs of opposing sides;

a frame portion connected to a first side of each of the key tops, the frame including respective first and second hinges extending substantially linearly from opposite ends of the first side of each of the key tops, pivotally connecting each of the key tops to the frame, wherein each of the key tops has:

an operating portion spaced from the first side of the key top and having a first top surface lying substantially in a first plane, and a lower portion located between the operating portion and the first side, having a length and a second top surface lying in a second plane, wherein the first and second hinges lie in a third plane, the first second, and third planes being generally parallel to each other and the second plane being intermediate the first and third planes.

* * * * *